US011197506B2

(12) United States Patent
Arshava

(10) Patent No.: US 11,197,506 B2
(45) Date of Patent: Dec. 14, 2021

(54) AUGMENTATION MAMMOPLASTY POSTOPERATIVE SYSTEM

(71) Applicant: Natalia A. Arshava, Iowa City, IA (US)

(72) Inventor: Natalia A. Arshava, Iowa City, IA (US)

( * ) Notice: Subject to any disclaimer, the term of this patent is extended or adjusted under 35 U.S.C. 154(b) by 87 days.

(21) Appl. No.: 15/820,767

(22) Filed: Nov. 22, 2017

(65) Prior Publication Data

US 2019/0150525 A1 May 23, 2019

(51) Int. Cl.
*A41C 3/00* (2006.01)
*A41C 3/02* (2006.01)

(52) U.S. Cl.
CPC ..... *A41C 3/0064* (2013.01); *A41C 3/0021* (2013.01); *A41C 3/02* (2013.01)

(58) Field of Classification Search
CPC ..... A41C 3/0064; A41C 3/0021; A41C 3/02; A41C 3/0028; A41C 3/12; A41F 9/00; A41F 9/002; A41F 9/02; A41F 9/025
USPC ..... 2/311, 312, 321, 322
See application file for complete search history.

(56) References Cited

U.S. PATENT DOCUMENTS 1,667,796 A * 5/1928 Morrison ..... A41C 3/00 450/58
2,402,835 A * 6/1946 Nagy ..... A41C 3/00 2/67
2,406,699 A * 8/1946 Lustig ..... A41C 3/00 450/64
2,542,881 A * 2/1951 Ries ..... A41C 3/0078 450/59
3,407,819 A * 10/1968 Barnes ..... A41C 3/00 450/55
4,411,269 A * 10/1983 Weintraub ..... A41C 3/02 450/58
6,102,772 A * 8/2000 Fernandez ..... A41C 3/00 450/1
6,280,287 B1 * 8/2001 Keith ..... A41C 3/0028 450/1
6,896,582 B2 * 5/2005 Kawami ..... A41C 3/06 450/64
8,007,343 B1 * 8/2011 Komsky ..... A41C 3/00 450/54
9,681,692 B2 * 6/2017 Hansen ..... A41C 3/0064
9,700,080 B1 * 7/2017 Hansraj ..... A41C 3/0021
(Continued)

OTHER PUBLICATIONS https://academic.oup.com/asj/article/34/5/776/185113, "Aesthetic Surgery Journal, Oxford Academic", vol. 34, Issue 5, pp. 776-781, accessed on Jan. 9, 2018.

*Primary Examiner* — Jocelyn Bravo
(74) *Attorney, Agent, or Firm* — McKee, Voorhees & Sease, PLC

(57) ABSTRACT

A post-operative breast support system is provided for use following augmentation mammoplasty to prevent or correct implant migration. The support system includes a pair of straps which extend over the patient's shoulders, then cross one another at the patient's chest, then extend under opposite left and right breasts, then around the patient's back in opposite directions, and then forwardly around the torso to the front of the patient, wherein the ends of the straps are fastened or buckled. The straps have a width which prevents twisting. The fastener is adjustable, such that the tension and position of the straps can be quickly and easily set by the patient.

8 Claims, 3 Drawing Sheets

(56) References Cited

U.S. PATENT DOCUMENTS

| | | | | |
|---|---|---|---|---|
| 2008/0194178 | A1* | 8/2008 | Smith | A41C 3/0064 450/8 |
| 2009/0047866 | A1* | 2/2009 | Smith | A41C 3/06 450/88 |
| 2009/0126163 | A1* | 5/2009 | Groner | A41C 3/0028 24/302 |
| 2010/0130098 | A1* | 5/2010 | Kammerer | A41C 3/02 450/39 |
| 2012/0094576 | A1* | 4/2012 | Tedder | A41C 3/08 450/92 |
| 2013/0029561 | A1* | 1/2013 | Lin | A41F 1/006 450/86 |
| 2013/0065486 | A1* | 3/2013 | Hansen | A41C 3/0028 450/59 |
| 2014/0162531 | A1* | 6/2014 | Mazourik | A41C 3/0028 450/86 |
| 2017/0181479 | A1* | 6/2017 | Mazourik | A41C 3/0028 |
| 2017/0196274 | A1* | 7/2017 | Hansraj | A41C 3/0021 |

* cited by examiner

AUGMENTATION MAMMOPLASTY POSTOPERATIVE SYSTEM

BACKGROUND OF THE INVENTION

Breast augmentation is the most common cosmetic surgery procedure performed in the United States, according to the American Society for Aesthetic Plastic Surgery. Augmentation mammoplasty is the operation when an artificial implant is used to replace the volume of breast tissue lost during removal of a tumor, or for a patient who seeks augmentation of the breast shape for cosmetic reasons. While this surgery has been developed and refined over the years, complications may still arise for the patient. One of the most common post-operative problems is implant malposition, wherein the implant moves downwardly or laterally from an initial position relative to the position of the inframammary fold. Such migration of the implant produces deformities, often called a "double-bubble", "bottoming out", and "breast ptosis". The most common treatment for these deformities is a second surgery, which creates additional risks, costs, and potential for increased patient dissatisfaction. Early implant malposition may arise due to unrecognized preexisting congenital deformities, technical errors during pocket dissection, and use of an improperly large implant in a breast that had little preexisting soft tissue coverage.

As an alternative to corrective surgery to reposition the implant, a known prior art non-surgical technique utilizes a shoe lace to form a "breast cast". The shoe lace cast is made from two 54" long, ¾ inch wide, flat shoe laces. The shoe laces are tied together at one end, and then placed around the patient's neck, draped down the center of the chest, and knotted again between the breasts. Then the shoe laces are wrapped underneath the inframammary crease or fold. The free end is then wrapped around the back, crossed, brought back to the front and tied beneath the inframammary fold. The shoe laces are wrapped tightly to prevent the implant from squeezing beneath the shoe lace.

This shoe lace cast for correcting implant malposition is uncomfortable, and thus discourages patients from using the device, which normally must be worn for several weeks at all times, except for showers or bathing. The shoe lace cast exerts pressure on the patient's neck, is painful because of twisting of the shoe lace, and can cut into the skin due to the small dimensions of the shoe lace. The shoe lace can also cause headaches. Also, the knot between the breasts and below the breasts creates pressure points on the skin, which is also painful and uncomfortable. The shoe laces are also difficult to adjust, and requires re-tying of the knots for proper positioning of the shoe laces under the breast fold.

Therefore, a primary objective of the present invention is the provision of an improved support system for post-operative augmentation mammoplasty.

Another objective of the present invention is the provision of support straps for use in correcting or preventing breast implant migration following augmentation plastic surgery.

A further objective of the present invention is the provision of a support system for postoperative mammoplasty augmentation which eliminates or minimizes the need for follow up surgical procedures.

Still another objective of the present invention is the provision of a method for preventing downward and lateral migration of a breast implant using straps which go over the patient's shoulders and along the inframammary crease.

Yet another objective of the present invention is a provision of a support system for augmentation mammoplasty which is quick and easy to put on and adjust, and comfortable to wear.

A further objective of the present invention is the provision of a post-operative support system for a patient who has under gone breast augmentation surgery, wherein the support system is economical to manufacture, durable, and safe in use.

These and other objectives have become apparent from the following description of the invention.

SUMMARY OF THE INVENTION

The breast implant support system of the present invention is used following augmentation mammoplasty to prevent implant migration downwardly and laterally and to eliminate or minimize second surgeries to correct deformities from malpositioned implants. The support system includes first and second straps which extend over opposite shoulders of the patient, and then under the inframammary crease of the left and right breasts. The straps then extend around the patient's back in opposite directions, and then forwardly around the patient's torso to a position centered between and below the breast, wherein the strap ends are coupled together. The straps are adjustable to provide a snug fit. The straps do not extend around the patient's neck.

In the method of preventing breast implant migration, the free ends of the straps extend from behind the patient's back up and over the shoulders, and then crisscross with one another between the patient's breasts, and then under the breast opposite the shoulders for positioning along the inframammary crease. The straps then extend rearwardly around the patient's torso, and then forwardly around the torso to a position substantially centered between and below the breasts, wherein the free ends are fastened together. The straps can be adjusted as needed, for fit and comfort.

DETAILED DESCRIPTION OF THE PREFERRED EMBODIMENTS

Figure 2:
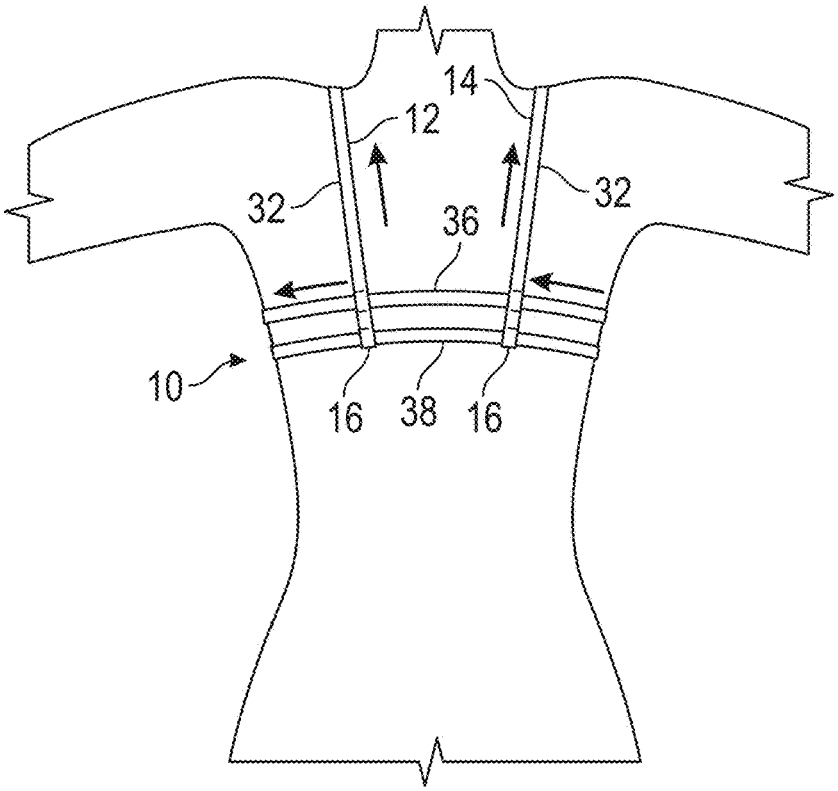
FIG. 2 is a view from the back of the patient wearing the support system of the present invention.
Figure 3:
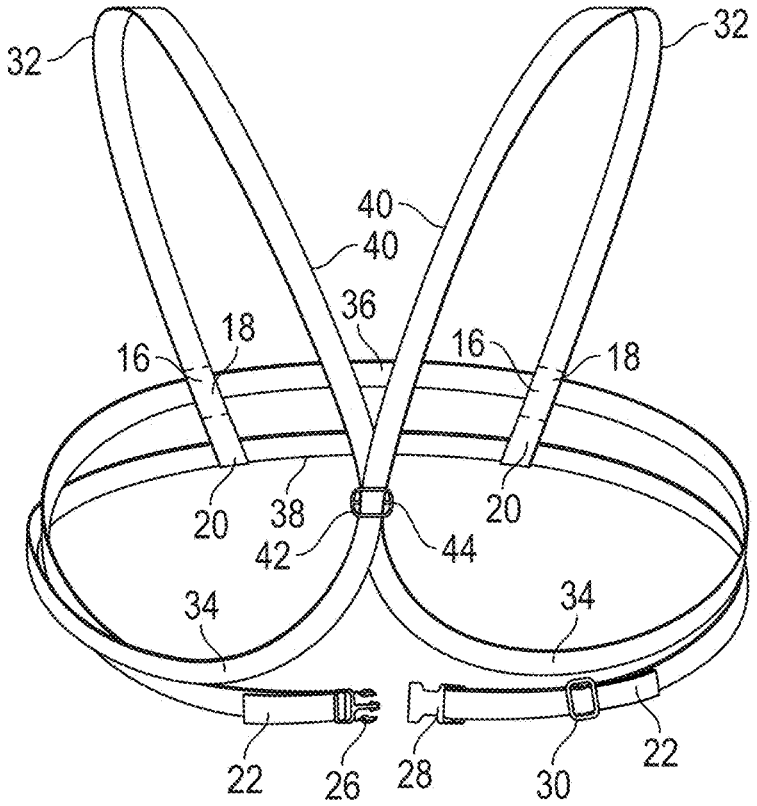
FIG. 3 is a front elevation view of the support system.

The augmentation mammoplasty post-operative support system of the present invention is generally designated in the drawings by the reference numeral 10. The support system 10 includes first and second straps 12, 14 which generally extend in opposite directions from one another when the system 10 is worn by a patient. Each strap 12, 14 has opposite ends. In the preferred embodiment, the first end of 16 of each strap 12, 14 is folded over and stitched to itself so as to form an upper loop 18 and a lower loop 20 through which the straps extend, as shown in FIG. 2. As an alternative to the dual loops 18, 20, the ends 16 may include a single loop or a ring for receiving the straps 12, 14. The second end 22 of each strap 12, 14 includes a fastener or coupler 24, which may take any convenient form. As shown in the drawings, the fastener 24 is a clip or buckle with a male member 26 adapted to be releasably inserted into a female member 28. Alternatively, the fastener can be Velcro straps or another device which can quickly and easily connect and disconnect the ends 22 of the straps 12, 14. The strap ends 22 can be adjustably extended through the male and female members 26, 28. An adjustment retainer 30 is utilized in conjunction with the female member 28 to maintain the strap end 22 in the desired adjusted position.

In the preferred embodiment, the straps 12, 14 have a consistent width along their respective lengths, as shown in the drawings.

Figure 1:
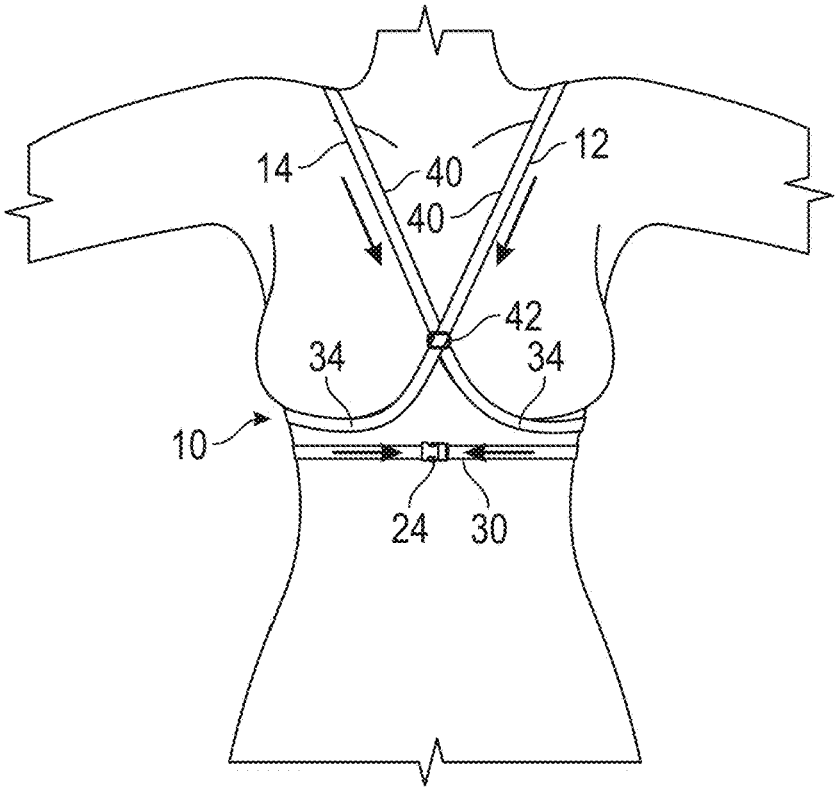
FIG. 1 is a front elevation view of the straps support system of the present invention, as worn on a patient following augmentation mammoplasty surgery.
Figure 4:
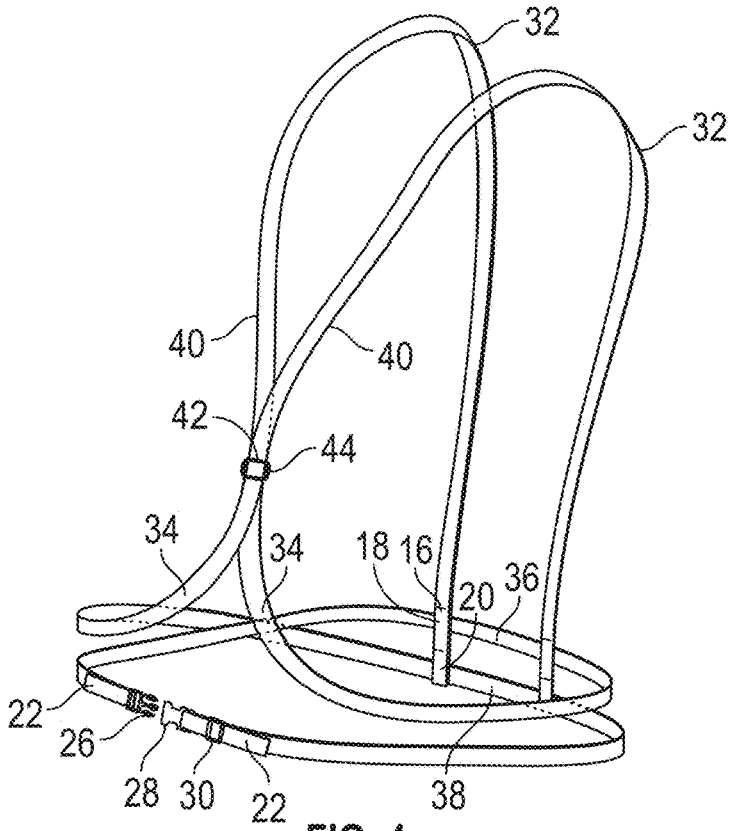
FIG. 4 is a side elevation view of the system.

When the support system 10 is worn by the patient, the first ends 16 are on the patient's back, with each strap standing upwardly to define a shoulder portion 32 extending over the patient's left and right shoulders. The straps 12, 14 then cross one another in front of the patient's chest, and then extend beneath the right and left breasts to define an inframammary portion 34 of the straps 12, 14, as shown in FIG. 1. The straps then continue in opposite directions rearwardly around the patient's back, defining back portions 36 of each strap 12, 14. The back portion 36 of the first strap 12 extends through the upper loops 18, while the back portion 38 of the second strap 14 extends through the lower loops 20, as shown in FIG. 2. The straps then extend forwardly around the patient's torso, such that the second ends 22 can be secured together by the fastener 24. As seen in FIG. 4, the straps cross one another on one lateral side but not on the other lateral side. In the preferred embodiment, the chest portion 40 of the straps 12, 14 extend through an adjustable ring 42 so that the point where the straps cross one another can be raised or lower by the patient. The ring 42 has a cross bar 44 to prevent accidental movement of the ring 42 after the ring position is set.

The loops 18, 20, or alternative structures, through which the back portions 36, 38 of the straps 12, 14 extend, prevent the straps from twisting and tangling. Another alternative fixes the back portions 36, 38 to the ends 16, by stitching or other means, thus eliminating the loops 18, 20, but still preventing twisting of the straps. The ring 42 also keeps the straps from twisting and maintains the straps flat against the patient's skin. Preferably, the straps are approximately 1 inch in width to prevent pressure points on the patient's skin, and to minimize or eliminate any tendency for twisting.

Once the support system 10 is on the patient, with the fastener 24 secured or locked, the tension of the straps 12, 14 and the position of the straps relative to the inframammary fold can be adjusted by tightening or loosening the second ends 22 of the straps via the buckles 26, 28 of the fastener 24.

Figure 5:
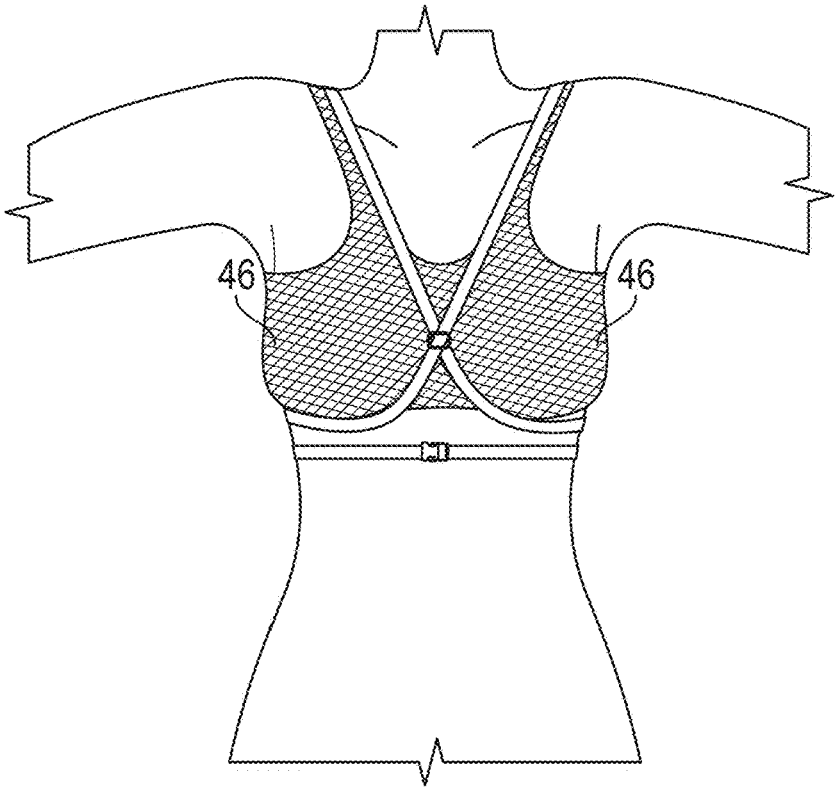
FIG. 5 is a front elevation view of an alternative embodiment wherein the support system is formed as part of a bra.
Figure 6:
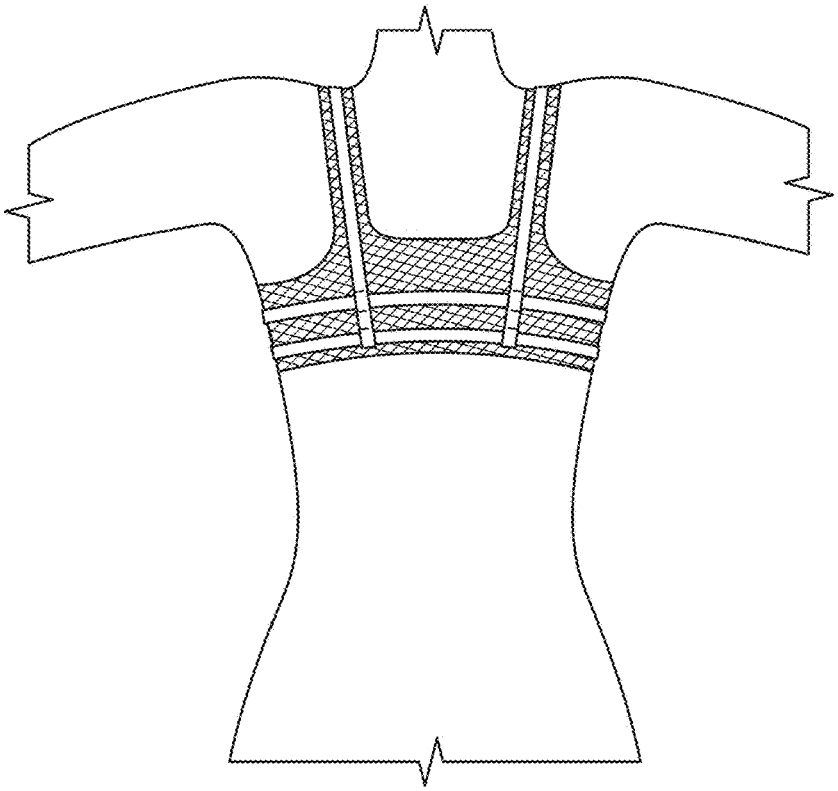
FIG. 6 is a rear elevation view of the support system shown in FIG. 5.

The support system 10 does not extend around the patient's neck, but rather goes over the shoulders for a more comfortable fit. The fastener or buckle 24 allows the patient to quickly put the strap system 10 on and off. Material may be added to the straps to form a bra 46 with cups, as shown in FIGS. 5 & 6. The straps may be on the inside or outside of the bra material. The material may form only the cups, or may also extend on the wearer's back, as seen in FIG. 7. The straps and bra configuration may still have the sliding ring 42 for adjustment.

The support system 10 can be used in early post-operative periods for the purpose of non-surgical correction or prevention of undesirable deformities that sometimes occur after augmentation mammoplasty. The support system 10 supports and repositions the implant into the desired position during the post-operative period. The support system can be used while the dense scar tissue around the implants forms. The inframammary position of the straps is guided by the preferred eventual position of the implant. The strap preferably should be positioned just below the inferior edge of the scar around the implant. Once the scar tissue matures, and is strong enough to secure the implant in place, the support system does not need to be worn by the patient.

Thus, the support system 10 can be used as a non-operative method of repositioning and casting of misplaced implants, thereby correcting post-operative deformities in a simple and safe manner, without the need for follow up surgery. The support system 10 allows for quick and easy placement on the torso, with adjustable straps as needed for height and tension. The comfort of the shoulder strap portions 32 improve compliance by the patient, as compared to a neck strap which can produce pain and discomfort.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A support system adapted for use following augmentation mammoplasty on breasts of a patient, comprising:

first and second straps adapted to extend vertically from a position adjacent shoulder blades of the patient and over opposite shoulders of the patient, and then diagonally downwardly toward the opposite breast to cross one another adjacent a chest area of the patient, and then under inframammary creases of the breasts, and then around a backside of the patient in opposite horizontal directions and back to a position on a front of the patient, each of the first and second straps having a substantially consistent width along a respective length of each strap;

the first and second straps configured to crossing one another on one lateral side of the patient but not on the opposite lateral side of the patient;

a coupler configured for securing ends of the straps together on the front of the patient; and a ring slidably mounted on both straps and configured to be positioned laterally between and adjacent the breasts; and each strap having a back portion with an upper loop and a lower loop, and one of the straps slidably extending through the upper loops of the first and second straps, and the other of the straps slidably extending through the lower loops of the first and second straps.

2. The support system of claim 1 wherein each strap has a rear end, a shoulder portion, a front portion, an inframammary portion, a back portion, a chest portion and a front end.

3. The support system of claim 2 wherein the front ends of the straps are releasably joined by the coupler.

4. The support system of claim 3 wherein the coupler is adjustable.

5. The support system of claim 1 wherein the coupler is adjustable.

6. The support system of claim 1 wherein the straps each have a width of approximately 1 inch.

7. The support system of claim 1 wherein the straps are configured to not extend around a back of a neck of the patient.

8. The support system of claim 1 further comprising material attached to the straps and forming bra cups.

* * * * *